US010274230B2

(12) United States Patent
Bao et al.

(10) Patent No.: US 10,274,230 B2
(45) Date of Patent: Apr. 30, 2019

(54) ANNULAR PORTIONS PROTRUDING FROM A DISPLACER AND EXPANSION SPACE OF A CRYOCOOLER

(71) Applicant: SUMITOMO HEAVY INDUSTRIES, LTD., Tokyo (JP)

(72) Inventors: Qian Bao, Nishitokyo (JP); Mingyao Xu, Nishitokyo (JP); Koji Yamada, Nishitokyo (JP); Takaaki Morie, Yokosuka (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 1 day.

(21) Appl. No.: 15/497,771

(22) Filed: Apr. 26, 2017

(65) Prior Publication Data

US 2017/0227261 A1 Aug. 10, 2017

Related U.S. Application Data

(63) Continuation of application No. PCT/JP2015/079964, filed on Oct. 23, 2015.

(30) Foreign Application Priority Data

Oct. 30, 2014 (JP) ..... 2014-221052
Feb. 26, 2015 (JP) ..... 2015-036247

(51) Int. Cl.
*F25B 9/00* (2006.01)
*F25B 9/06* (2006.01)
(Continued)

(52) U.S. Cl.
CPC ..... *F25B 9/14* (2013.01)

(58) Field of Classification Search
CPC ..... F25B 9/00; F25B 9/06; F25B 9/10; F25B 9/14; F25B 9/145; F02G 1/0435; F02G 2243/00; F02G 2242/42; F02G 2256/00; F02G 2256/02; F02G 2255/20; F02G 1/04; F02G 1/047; F28F 2215/00;
(Continued)

(56) References Cited

U.S. PATENT DOCUMENTS 2,567,454 A * 9/1951 Taconis ..... F25B 9/14 62/6
3,220,178 A 11/1965 Dineen
(Continued)

FOREIGN PATENT DOCUMENTS

JP S57-174663 A 10/1982
JP H02-143058 A 6/1990
(Continued)

*Primary Examiner* — Frantz F Jules
*Assistant Examiner* — Erik Mendoza-Wilkenfel
(74) *Attorney, Agent, or Firm* — HEA Law PLLC

(57) ABSTRACT

In a cryocooler, a displacer includes an internal space, and a working gas flows through the internal space. A cylinder reciprocally accommodates the displacer, and an expansion space for the working gas is formed between the cylinder and a bottom portion of the displacer. A plurality of annular protruding portions are provided on a bottom surface of the expansion space such as to form a multiplex structure. A plurality of annular recessed portions are provided on the bottom portion of the displacer such as to receive the plurality of annular protruding portions.

11 Claims, 8 Drawing Sheets

(51) Int. Cl.

| | |
|---|---|
| ***F25B 9/10*** | (2006.01) |
| ***F25B 9/14*** | (2006.01) |
| ***F02G 1/04*** | (2006.01) |
| ***F28F 9/22*** | (2006.01) |

(58) Field of Classification Search
CPC ..... F28F 2215/02; F28F 2215/04; F28F 9/22; F28F 2009/222; F28F 2009/224; F28F 2009/226; F28F 2009/228
See application file for complete search history.

(56) References Cited

U.S. PATENT DOCUMENTS

| | | | | |
|---|---|---|---|---|
| 4,333,755 | A | 6/1982 | Sarcia | |
| 5,009,072 | A | 4/1991 | Nagao | |
| 2012/0073284 | A1* | 3/2012 | Chen | F02G 1/053 60/524 |
| 2013/0031916 | A1* | 2/2013 | Matsubara | F25B 9/14 62/6 |
| 2013/0327065 | A1 | 12/2013 | Xu et al. | |

FOREIGN PATENT DOCUMENTS

| | | | |
|---|---|---|---|
| JP | H05-306846 | A | 11/1993 |
| JP | 2609327 | B2 | 2/1997 |
| JP | H10-122683 | A | 5/1998 |
| JP | 2008-002712 | A | 1/2008 |
| JP | 2013-257074 | A | 12/2013 |
| JP | 5575880 | B2 | 7/2014 |

* cited by examiner

ANNULAR PORTIONS PROTRUDING FROM A DISPLACER AND EXPANSION SPACE OF A CRYOCOOLER

INCORPORATION BY REFERENCE

Priority is claimed to Japanese Patent Application Nos. 2014-221052 and 2015-036247, filed Oct. 30, 2014 and Feb. 26, 2015, the entire content of each of which is incorporated herein by reference.

BACKGROUND

Technical Field

Certain embodiments of the present invention relate to cryocoolers that, using a high-pressure working gas supplied from a compression device, set up Simon expansion to give rise to cryogenic coldness.

Description of Related Art

The Gifford-McMahon (GM) cryocooler is one known example of cryocoolers for producing cryogenic temperatures. In a GM cryocooler, by reciprocating a displacer inside a cylinder, the volume of an expansion space therein is varied. In accordance with the variation in volume, the exhaust end and intake ends of the compressor are selectively connected to the expansion space, whereby the working gas is expanded in the expansion space. In that state, the cooling target is chilled by coldness produced.

SUMMARY

A cryocooler in an embodiment of the present invention is provided with: a displacer having an internal space, for a working gas to flow through the internal space; a cylinder, reciprocally accommodating the displacer, between a bottom portion of the displacer and which an expansion space for the working gas is formed; a plurality of annular protruding portions provided on a bottom surface of the expansion space such as to form a multiplex structure; and a plurality of annular recessed portions provided on the bottom portion of the displacer such as to receive the plurality of annular protruding portions.

DETAILED DESCRIPTION

It is desirable to provide a technology which improves refrigerating performance of a cryocooler.

According to the present invention, it is possible to provide a technology which improves refrigerating performance of a cryocooler.

Embodiments of the present invention will be described with reference to the drawings.

First Embodiment

Figure 1B:
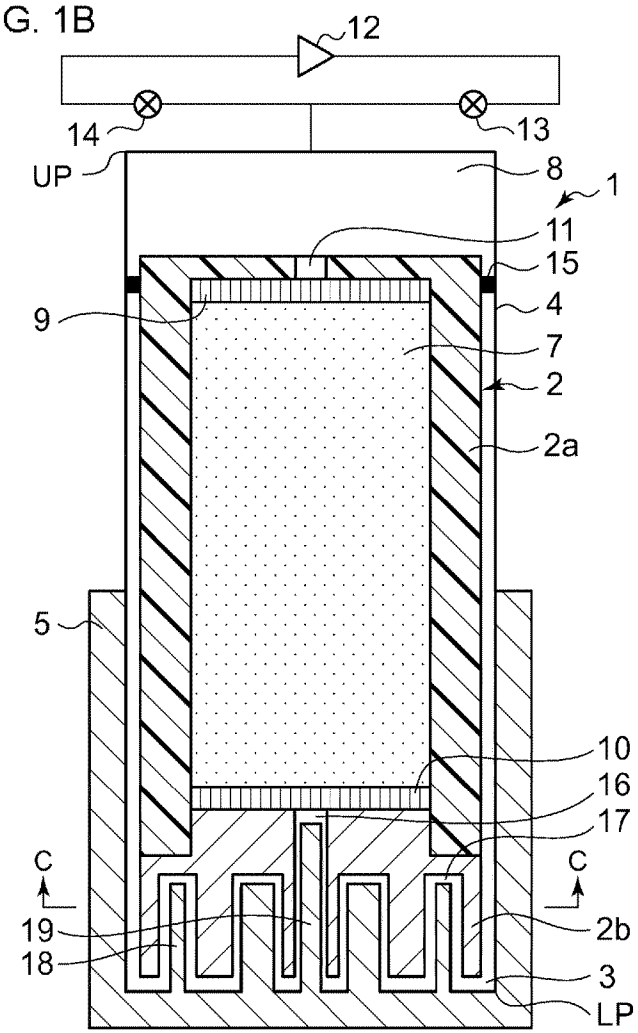
FIGS. 1A and 1B are views schematically showing a cryocooler according to a first embodiment of the present invention.
Figure 1A:
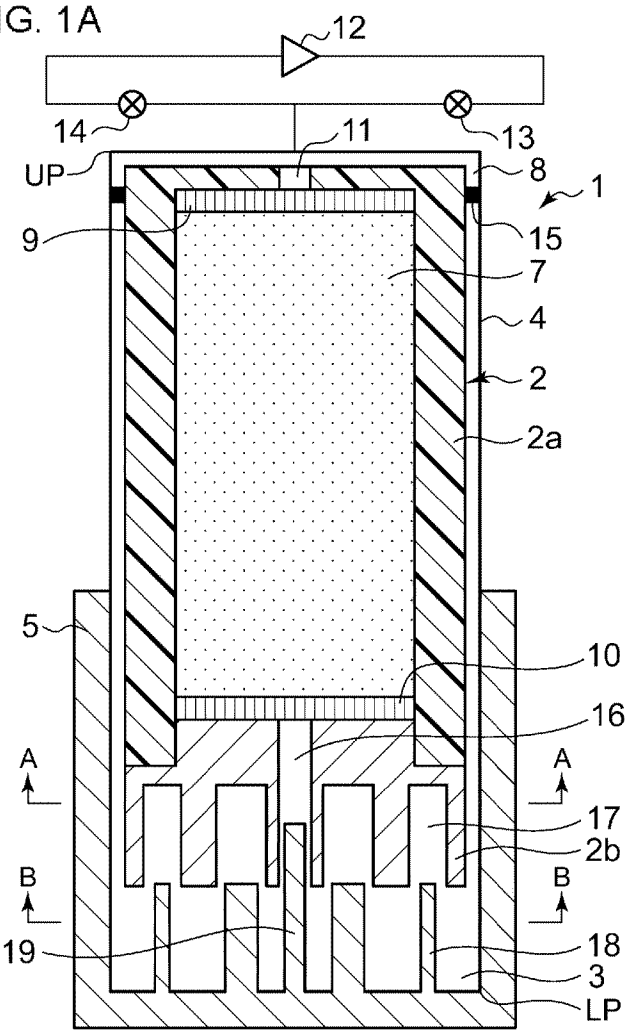

FIGS. 1A and 1B are views showing a cryocooler 1 according to a first embodiment of the present invention. For example, the cryocooler 1 according to the first embodiment is a Gifford-McMahon type cryocooler which uses helium gas as a working gas. The cryocooler 1 includes a displacer 2, a cylinder 4 which forms an expansion space 3 between the cylinder 4 and the displacer 2, and a bottomed cylindrical cooling stage 5 which is adjacent to the expansion space 3 and is positioned so as to enclose the expansion space 3. The cooling stage 5 functions as a heat exchanger which performs heat exchange between a cooling object and the working gas.

The compressor 12 recovers a low-pressure working gas from a suction side, compresses the low-pressure working gas, and thereafter, supplies a high-pressure working gas to the cryocooler 1. For example, helium gas may be used as the working gas. However, the present invention is not limited to this.

The cylinder 4 reciprocally accommodates the displacer 2 in a longitudinal direction. From the viewpoint of strength, thermal conductivity, helium sealing performance, or the like, for example, the cylinder 4 is formed of stainless steel.

The displacer 2 includes a main body portion 2*a* and a bottom portion 2*b*. From the viewpoint of specific weight, strength, thermal conductivity, or the like, for example, the main body portion 2*a* of the displacer 2 is formed of a phenol resin or the like. For example, a regenerator material is configured of a wire net or the like. The bottom portion 2*b* may be configured of the same member as that of the main body portion 2*a*. Moreover, the bottom portion 2*b* may be configured of a material which has higher thermal conductivity than that of the main body portion 2*a*. Accordingly, the bottom portion 2*b* function as a thermal conduction portion which performs heat exchange between the bottom portion 2*b* and the working gas flowing in the bottom portion 2*b*. For example, the bottom portion 2*b* is formed of a material having higher thermal conductivity than that of at least the main body portion 2*a* such as copper, aluminum, stainless steel, or the like. For example, the cooling stage 5 is configured of copper, aluminum, stainless steel, or the like.

A scotch yoke mechanism (not shown) which reciprocates the displacer 2 is provided on a high-temperature end of the displacer 2. The displacer 2 reciprocates between a top dead center UP and a bottom dead center LP in the cylinder 4 in the axial direction of the cylinder 4. In addition, FIG. 1A is a schematic view showing an aspect in which the displacer 2 is positioned at the top dead center UP in the cryocooler 1 according to the first embodiment. Moreover, FIG. 1B is a schematic view showing an aspect in which the displacer 2 is positioned at the bottom dead center LP in the cryocooler 1 according to the first embodiment.

The displacer 2 has a cylindrical outer peripheral surface, and the inside of the displacer 2 is filled with a regenerator material. The internal space of the displacer 2 configures the regenerator 7. An upper end flow smoother 9 and a lower end flow smoother 10 which causes the flow of helium gas to be smooth are respectively provided on the upper end side and the lower end side of the regenerator 7.

An upper opening 11 through which the working gas flows from a room-temperature chamber 8 to the displacer 2 is formed on a high-temperature end of the displacer 2. The room-temperature chamber 8 is a space which is formed between the cylinder 4 and the high-temperature end of the displacer 2, and the volume of the room-temperature chamber 8 is changed according to reciprocation of the displacer 2.

A common supply-return pipe among pipes by which suction/exhaust systems configured of the compressor 12, the supply valve 13, and the return valve 14 are connected to each other is connected to the room-temperature chamber 8. In addition, a seal 15 is mounted between the portion of the high-temperature end of the displacer 2 and the cylinder 4.

A working gas flow channel 16 through which the internal space of the displacer 2 and the expansion space 3 are connected to each other is formed on the bottom portion 2*b* of the displacer 2. The flow channel 16 penetrates the center portion of the bottom portion 2*b* of the displacer 2 and functions as a blow-off port of the working gas through which the working gas is introduced into the expansion space 3. In addition, the flow channel 16 functions as a suction port of the working gas through which the working gas in the expansion space 3 is returned to the internal space of the displacer 2.

The expansion space 3 is a space which is formed by the cylinder 4 and the displacer 2, and the volume of the expansion space 3 is changed according to the reciprocation of the displacer 2. The cooling stage 5 which is thermally connected to a cooling object is disposed at the positions of the outer circumference and the bottom portion of the cylinder 4 corresponding to the expansion space 3. A working gas is supplied to the expansion space 3 by the working gas which flows into the expansion space 3 through the flow channel 16.

A plurality of annular protruding portions 18 are provided on the bottom surface of the expansion space 3 so as to form a multiple structure. In addition, a plurality of annular recessed portions 17 which are provided so as to receive the plurality of annular protruding portions 18 are provided on the bottom portion 2*b* of the displacer 2. In addition, a bar-shaped member 19 is provided on a region of the bottom surface of the expansion space 3 facing the flow channel 16. The bar-shaped member 19 is configured to be inserted into the flow channel 16 at least when the displacer 2 is positioned at the bottom dead center LP. In addition, the recessed portions 17, the protruding portions 18, and the bar-shaped member 19 will be described in detail below.

Next, the operation of the cryocooler 1 will be described. At a time of a working gas supply step, as shown in FIG. 1B, the displacer 2 is positioned at the bottom dead center LP of the cylinder 4. Simultaneously with this or at timing which is slightly deviated from this, if the supply valve 13 is open, a high-pressure working gas is supplied from the common supply-return pipe into the cylinder 4 via the supply valve 13. As a result, the high-pressure working gas flows into the regenerator 7 inside the displacer 2 from the upper opening 11 positioned on the upper portion of the displacer 2. The high-pressure working gas which flows into the regenerator 7 is supplied to the expansion space 3 via the flow channel 16 positioned on the lower portion of the displacer 2 while being cooled by a regenerator material.

If the expansion space 3 is filled with the high-pressure working gas, the supply valve 13 is closed. At this time, as shown in FIG. 1A, the displacer 2 is positioned at the top dead center UP in the cylinder 4. Simultaneously with or at timing which is slightly deviated from when the displacer 2 is positioned at the top dead center UP in the cylinder 4, if the return valve 14 is open, the pressure of the working gas in the expansion space 3 is decreased and expanded. The helium gas in the expansion space 3 in which the temperature is decreased by the expansion absorbs the heat of the cooling stage 5 as the working gas.

The displacer 2 moves toward the bottom dead center LP, and the volume of the expansion space 3 is decreased. The working gas inside the expansion space 3 is returned to the displacer 2 through the flow channel 16. At this case, the working gas absorbs the heat of the cooling stage 5. The working gas which is returned to the regenerator 7 from the expansion space 3 also cools the regenerator material inside the regenerator 7. The working gas recovered to the displacer 2 is returned to the suction side of the compressor 12 via the regenerator 7 and the upper opening 11. The above-described step is set to one cycle, and the cryocooler 1 repeats this cooling cycle to cool the cooling stage 5.

Figure 2A:
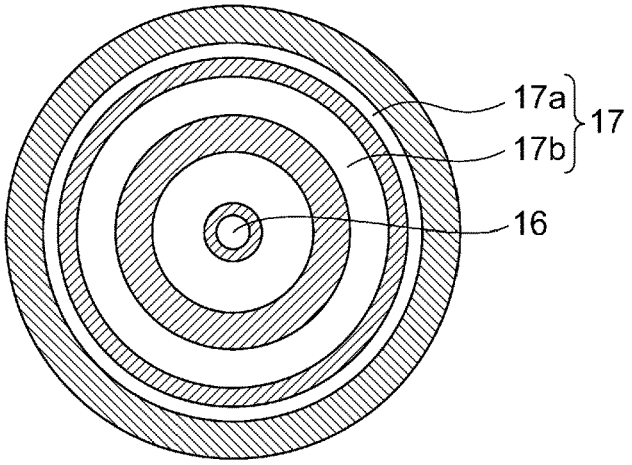
FIGS. 2A to 2C are views schematically showing cross sections when the cryocooler according to the first embodiment is taken along a plan perpendicular to an axial direction of a cylinder.
Figure 2B:
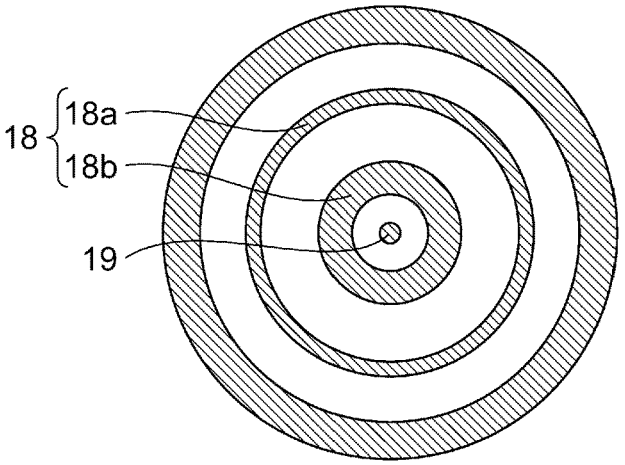
Figure 2C:
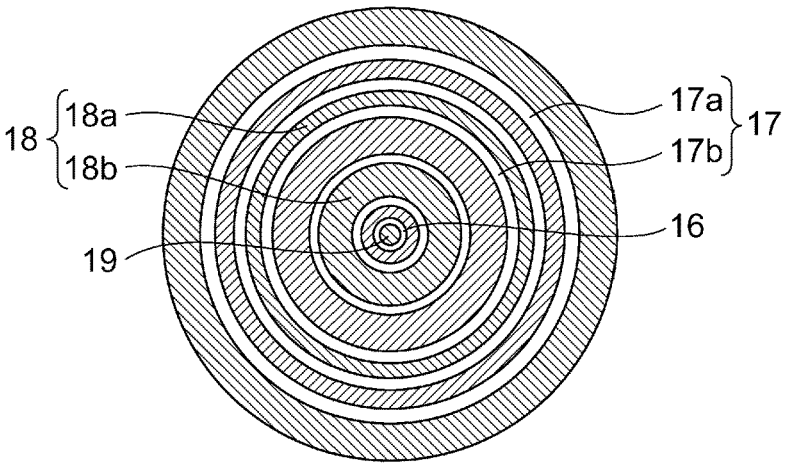

FIGS. 2A to 2C are views showing cross sections when the cryocooler 1 according to the first embodiment is taken along a plan perpendicular to the axial direction of the cylinder 4. More specifically, FIG. 2A is a view showing a cross section taken along a line A-A in FIG. 1A. In addition, FIG. 2B is a view showing a cross section taken along a line B-B in FIG. 1A. FIG. 2C is a view showing a cross section taken along a C-C line in FIG. 1B.

As described above, the displacer 2 has a cylindrical outer peripheral surface. Accordingly, each of the recessed portions 17 provided on the bottom portion 2*b* of the displacer 2 has a cylindrical shape. In the example shown in FIG. 2A, two recessed portions such as a first recessed portion 17*a* and a second recessed portion 17*b* are provided on the bottom portion 2*b* of the displacer 2, and each of the two recessed portions is formed in an annular groove. In the following specification, in a case where the first recessed portion 17*a* and the second recessed portion 17*b* are not particularly classified, the first recessed portion 17*a* and the second recessed portion 17*b* are collectively referred to as a "recessed portion 17."

The radius of the first recessed portion 17*a* is larger than the radius of the second recessed portion 17*b*. Accordingly, as shown in FIG. 2A, the second recessed portion 17*b* is provided inside the first recessed portion 17*a*. In this way, the recessed portion 17 has a multiple structure in which a plurality of annular grooves are formed in a so-called "nested" manner. In addition, the flow channel 16 is not formed in an annular shape. However, the flow channel 16 can be regarded as one of the recessed portions provided on the bottom portion 2*b* of the displacer 2.

A plurality of multiple protruding portions 18 which are provided so as to be a multiple structure are provided in the region of the expansion space 3 facing the recessed portion 17, that is, on the bottom surface of the expansion space 3. In the example shown in FIG. 2B, two protruding portions such as a first protruding portion 18*a* and a second protruding portion 18*b* are provided. In the following specification, in a case where the first protruding portion 18*a* and the second protruding portion 18*b* are not particularly classified, the first protruding portion 18*a* and the second protruding portion 18*b* are collectively referred to as a "protruding portion 18."

Here, each of the first recessed portion 17*a* and the second recessed portion 17*b* is formed so as to have a groove having a wider width than a thickness of each protruding portion 18 to receive each of the first protruding portion 18*a* and the second protruding portion 18*b* with an allowance. The allowance or clearance which is formed when the recessed portion 17 accommodates the protruding portion 18 is a flow channel of the working gas inside the expansion space 3.

The bar-shaped member 19 may be provided at the position of the bottom surface of the expansion space 3 facing the flow channel 16. The bar-shaped member 19 is formed so as to be inserted into the flow channel 16 at least when the displacer 2 is positioned at the bottom dead center LP. In addition, the bar-shaped member 19 may be formed such that at least a portion of the bar-shaped member 19 is inserted into the flow channel 16 when the displacer 2 is positioned at the top dead center UP. Accordingly, the height of the bar-shaped member 19, that is, the length of the bar-shaped member 19 in the axial direction of the cylinder 4 may be larger than the height of the protruding portion 18.

The bar-shaped member 19 has a thickness by which a clearance is formed between the bar-shaped member 19 and the flow channel 16 when the bar-shaped member 19 is inserted into the flow channel 16. Accordingly, even when the bar-shaped member 19 is inserted into the flow channel 16, the working gas can flow through the clearance between the bar-shaped member 19 and the flow channel 16. In addition, the bar-shaped member 19 is not formed in an annular shape and is formed in a cylindrical shape. However, the bar-shaped member 19 can be regarded as one of the protruding portions provided on the bottom surface of the expansion space 3.

FIG. 2C is a view showing a clearance which is formed between the recessed portion 17 and the protruding portion 18 when each recessed portion 17 is inserted into each protruding portion 18. As shown in FIG. 2C, in the clearances which is formed when the recessed portion 17 accommodates the protruding portion 18, the clearance which is formed to be far from the center axis of the displacer 2 is formed to be wider than the clearance which is formed to be close to the center axis of the displacer 2.

For example, the clearance which is formed when the second protruding portion 18*b* is accommodated in the second recessed portion 17*b* is wider than the clearance which is formed between the flow channel 16 and the bar-shaped member 19 when the bar-shaped member 19 is accommodated in the flow channel 16. Similarly, the clearance which is formed when the first protruding portion 18*a* is accommodated in the first recessed portion 17*a* is wider than the clearance which is formed when the second protruding portion 18*b* is accommodated in the second recessed portion 17*b*. Much more working gas exists in the outer side of the expansion space 3 than in the inner side thereof. A flow channel resistance is decreased by increasing the clearance which is formed to be far from the center axis of the displacer 2, and as a result, it is possible to decrease a pressure loss of the cryocooler 1.

Various methods for realizing this are considered. For example, the width of the groove of the first recessed portion 17*a* is the same as the width of the groove of the second recessed portion 17*b*, and the thickness of the first protruding portion 18*a* is thinner than the thickness of the second protruding portion 18*b*. Accordingly, the clearance which is formed when the first protruding portion 18*a* is accommodated in the first recessed portion 17*a* is wider than the clearance which is formed when the second protruding portion 18*b* is accommodated in the second recessed portion 17*b*. As another method, the thickness of the first protruding portion 18*a* may be the same as the thickness of the second protruding portion 18*b*, and the width of the groove of the first recessed portion 17*a* may be wider than the width of the groove of the second recessed portion 17*b*. Accordingly, the clearance which is formed when the first protruding portion 18*a* is accommodated in the first recessed portion 17*a* is wider than the clearance which is formed when the second protruding portion 18*b* is accommodated in the second recessed portion 17*b*.

Alternatively, as the example shown in FIGS. 1A and 1B, the width of the groove of the first recessed portion 17*a* maybe different from the width of the groove of the second recessed portion 17*b*, and the thickness of the first protruding portion 18*a* may be different from the thickness of the second protruding portion 18*b*. In the example shown in FIGS. 1A and 1B, the width of the groove of the first recessed portion 17*a* is narrower than the width of the groove of the second recessed portion 17*b*. Accordingly, since the clearance which is formed when the first protruding portion 18*a* is accommodated in the first recessed portion 17*a* is wider than the clearance which is formed when the second protruding portion 18*b* is accommodated in the second recessed portion 17*b*, the thickness of the first protruding portion 18*a* is narrower than the thickness of the second protruding portion 18*b*. Accordingly, each of the width of the recessed portion 17 and the thickness of the protruding portion 18 may be configured to be any one as long as the clearance which is formed when the first protruding portion 18*a* is accommodated in the first recessed portion 17*a* is wider than the clearance which is formed when the second protruding portion 18*b* is accommodated in the second recessed portion 17*b*.

The example shown in FIG. 2C is an example showing a case where the first protruding portion 18*a* having an annular shape is received in the center of the first recessed portion 17*a* which is a groove having an annular shape. Similarly, in the example shown in FIG. 2C, the second protruding portion 18*b* having an annular shape is received in the center of the second recessed portion 17*b* which is a groove having an annular shape. Accordingly, the gap which is formed on the inner side between the first protruding portion 18*a* and the first recessed portion 17*a* is the same as the gap which is formed on the outer side. Instead of this, the inner side gap formed between the first protruding portion 18*a* and the first recessed portion 17*a* may be narrower than the outer side gap. For example, this can be realized by decreasing the radius of the first protruding portion 18*a* or increasing the radius of the first recessed portion 17*a*. The relationship between the second protruding portion 18*b* and the second recessed portion 17*b* also is similar.

Figure 3:
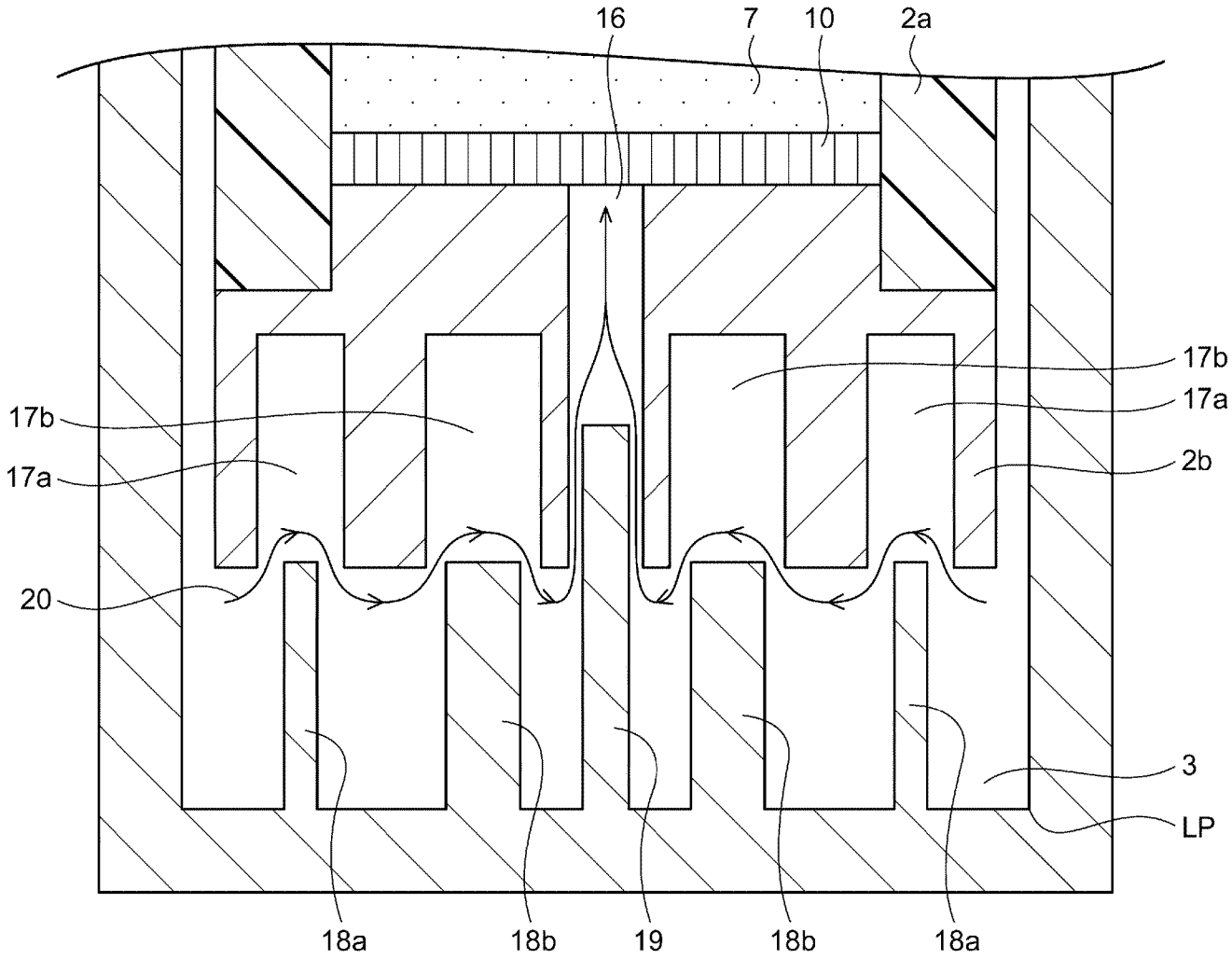
FIG. 3 is a schematic view showing a pathway through which a working gas passes when the working gas in an expansion space is recovered to an internal space of a displacer.

FIG. 3 is a schematic view showing a pathway through which the working gas passes when the working gas in the expansion space 3 is recovered to the internal space of the displacer 2, and is a view showing the expansion space 3 in an enlarged manner when the displacer 2 is positioned at the top dead center UP. As shown in FIG. 3, the recessed portion 17 is formed so as to accommodate the protruding portion 18 even when the displacer 2 is positioned at the top dead center UP. That is, even in a case where the displacer 2 is positioned at any position during the reciprocation, at least a portion of the protruding portion 18 is accommodated in the recessed portion 17. Accordingly, it is possible to prevent the protruding portion 18 from being deviated from the recessed portion 17 and coming into contact with the bottom portion 2*b* of the displacer 2 during the reciprocation of the displacer 2.

The working gas expanded in the expansion space 3 is recovered to the internal space of the displacer 2 through the flow channel 16. Since the flow channel 16 is provided at the center portion of the expansion space 3, the working gas inside the expansion space 3 is recovered so as to move from the outer side of the expansion space 3 toward the inner side thereof. In FIG. 3, an arrow 20 indicates the flow channel of the working gas in the recovery step. As shown by the arrow 20, the working gas passes through the clearance between the recessed portion 17 and the protruding portion 18. Compared to a case where the recessed portion 17 and the protruding portion 18 are not formed, since the clearance functions as a heat exchanger, a heat exchange area between the working gas and the cooling stage 5 increases, and heat exchange efficiency increases.

Particularly, since much more working gas exists in the outer side of the expansion space 3 than in the inner side thereof, the heat exchange between the working gas and the cooling stage 5 is performed while much working gas is recovered to the internal space of the displacer 2. As a result, heat exchange efficiency increases.

In addition, the operation in which the protruding portion 18 is inserted into the recessed portion 17 is repeated according to the reciprocation of the displacer 2. As a result, turbulence is generated in the working gas in the expansion space 3. Accordingly, it is possible to further increase the heat exchange efficiency between the working gas and the cooling stage 5.

In addition, as described above, the bar-shaped member 19 is inserted into the flow channel 16 during the reciprocation of the displacer 2. Accordingly, it is possible to prevent the volume of the flow channel 16 from being a dead volume. In addition, since the clearance between the bar-shaped member 19 and the flow channel 16 functions as a heat exchanger, it is possible to further increase the heat exchange area between the working gas and the cooling stage 5. Moreover, the volume of the first recessed portion 17*a* and the volume of the second recessed portion 17*b* may be the same as each other or may be similar to each other. Accordingly, the distribution of the working gas in the expansion space 3 is leveled, and it is possible to further increase the heat exchange efficiency between the working gas and the cooling stage 5.

As described above, according to the cryocooler 1 of the first embodiment, it is possible to increase the heat exchange area between the working gas and the cooling stage 5 when the working gas expanded in the expansion space 3 is recovered to the internal space of the displacer 2. In addition, it is possible to generate turbulence in the working gas when the protruding portion 18 is accommodated in the recessed portion 17. Accordingly, it is possible to improve the heat exchange efficiency between the working gas and the cooling stage 5, and it is possible to improve refrigerating performance of the cryocooler 1.

Second Embodiment

A cryocooler 1 according to a second embodiment will be described. Hereinafter, descriptions overlapping those of the cryocooler 1 according to the first embodiment are appropriately omitted or simplified.

Figure 4B:
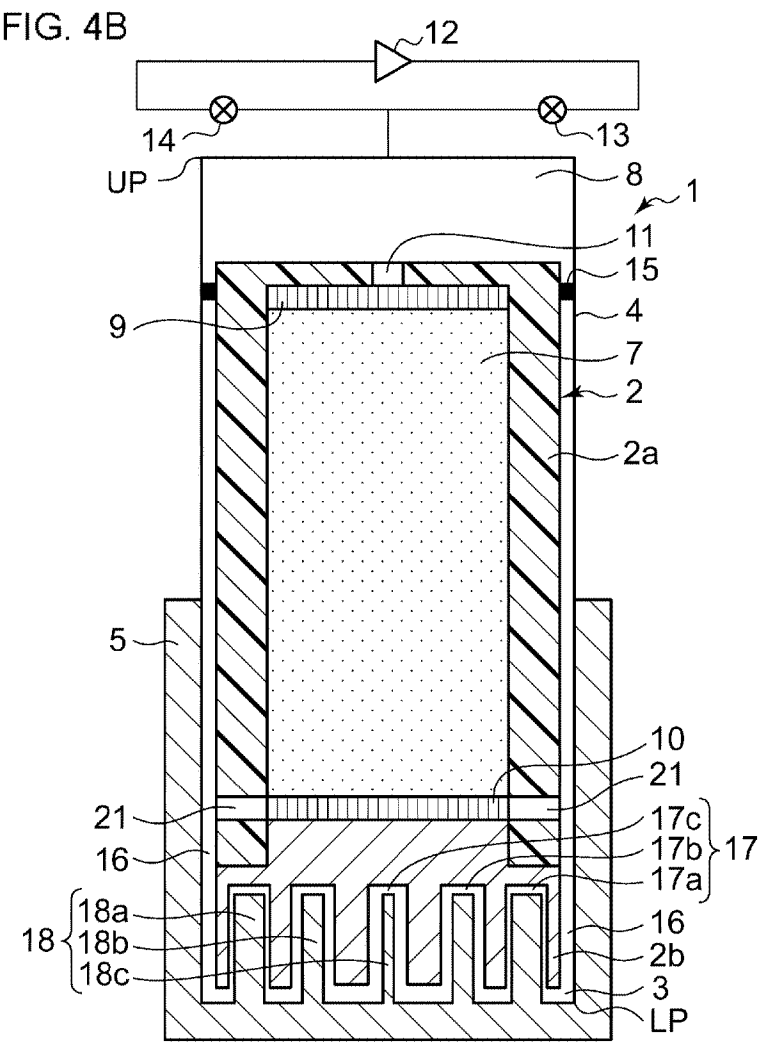
FIGS. 4A and 4B are views schematically showing a cryocooler according to a second embodiment of the present invention.
Figure 4A:
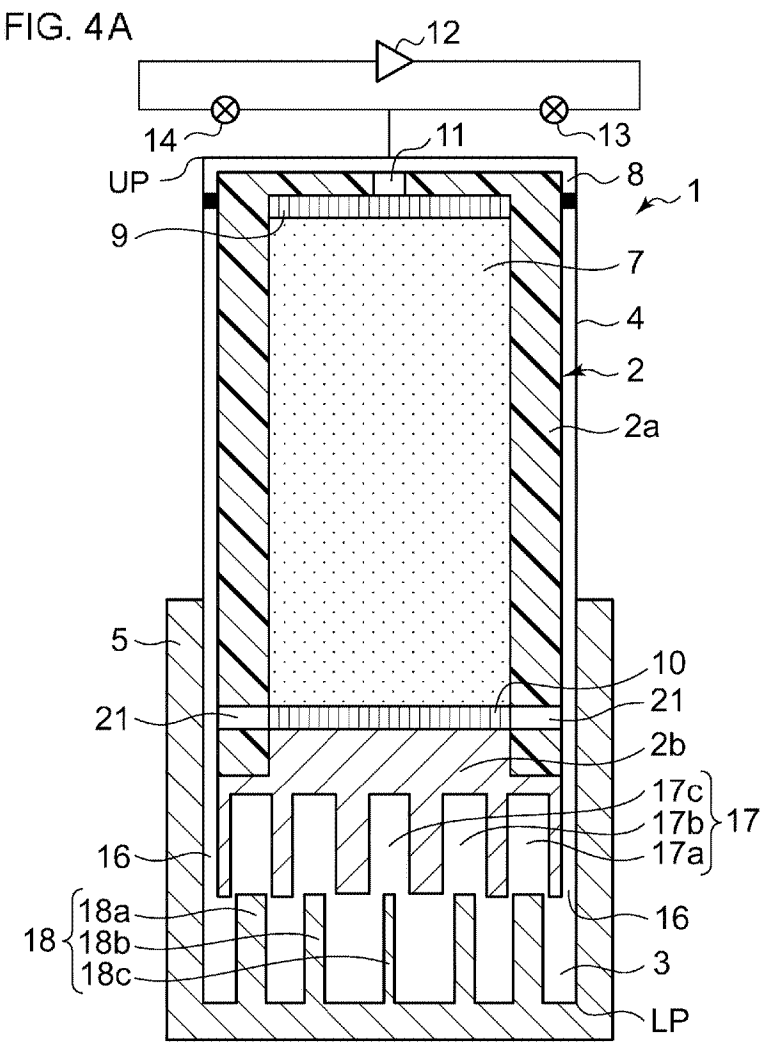

FIGS. 4A and 4B are views showing a cryocooler 1 according to a second embodiment of the present invention. Specifically, FIG. 4A is a schematic view showing an aspect in which the displacer 2 is positioned at the top dead center UP in the cryocooler 1 according to the second embodiment. Moreover, FIG. 4B is a schematic view showing an aspect in which the displacer 2 is positioned at the bottom dead center LP in the cryocooler 1 according to the second embodiment.

Similarly to the cryocooler 1 according to the first embodiment, in the cryocooler 1 according to the second embodiment, the plurality of annular protruding portion 18 are provided on the bottom surface of the expansion space 3 so as to form a multiple structure. In addition, the plurality of annular recessed portions are provided on the bottom portion 2*b* of the displacer 2 so as to receive the protruding portions 18.

Meanwhile, unlike the cryocooler 1 according to the first embodiment, in the cryocooler 1 according to the second embodiment, the working gas flow channel is not provided, which penetrates the center portion of the bottom portion 2*b* of the displacer 2 and through which the internal space of the displacer 2 and the expansion space 3 are connected to each other. Instead of the working gas flow channel, in the cryocooler 1 according to the second embodiment, a clearance between a side wall of the displacer 2 and an inner wall of the cylinder 4 becomes the flow channel 16 through which the internal space of the displacer 2 and the expansion space 3 are connected to each other. In addition, in the displacer 2 of the cryocooler 1 according to the second embodiment, a blow-off port 2*l* through which the working gas is introduced into the clearance becoming the flow channel 16 is provided. Accordingly, in the cryocooler 1 according to the second embodiment, the internal space of the displacer 2 and the expansion space 3 communicate with each other via the blow-off port 21 and the flow channel 16.

Accordingly, unlike the cryocooler 1 according to the first embodiment, in the cryocooler 1 according to the second embodiment, the working gas moves from the inner side of the expansion space 3 to the outer side thereof so as to be recovered to the displacer 2. That is, the length of the pathway until the working gas existing in the inner side of the expansion space 3 is recovered to the internal space of the displacer 2 is longer than that of the working gas existing in the outer side of the expansion space 3.

Accordingly, as shown in FIGS. 4A and 4B, in the clearances formed when the recessed portion 17 accommodates the protruding portion 18, the clearance which is formed to be close to the center axis of the displacer 2 is formed to be wider than the clearance which is formed to be far from the center axis of the displacer 2. Accordingly, the flow channel resistance on the inner side of the expansion space 3 decreases when the working gas is exhausted. The flow channel resistance of the pathway having the longest length decreases when the working gas is recovered, and it is possible to increase a decrease effect of the pressure loss of the cryocooler 1.

Various methods for realizing this are considered. For example, the width of the groove of the first recessed portion 17*a*, the width of the groove of the second recessed portion 17*b*, and the width of the groove of a third recessed portion 17*c* are the same as each other, and the thickness of the first protruding portion 18*a* is thicker than the thickness of the second protruding portion 18*b*. In addition, the thickness of the second protruding portion 18*b* is thicker than the thickness of the third protruding portion 18*c*. Accordingly, the clearance which is formed when the first protruding portion 18*a* is accommodated in the first recessed portion 17*a* is narrower than the clearance which is formed when the second protruding portion 18*b* is accommodated in the second recessed portion 17*b*. In addition, the clearance which is formed when the second protruding portion 18*b* is accommodated in the second recessed portion 17*b* is narrower than the clearance which is formed when the third protruding portion 18*c* is accommodated in the third recessed portion 17*c*.

As another method, the thickness of the first protruding portion 18*a*, the thickness of the second protruding portion 18*b*, and the thickness of the third protruding portion 18*c* are the same as each other, and the width of the groove of the first recessed portion 17*a* is narrower than the width of the groove of the second recessed portion 17*b*. In addition, the width of the groove of the second recessed portion 17*b* is narrower than the width of the groove of the third recessed portion 17*c*. Accordingly, the clearance which is formed when the first protruding portion 18*a* is accommodated in the first recessed portion 17*a* is narrower than the clearance which is formed when the second protruding portion 18*b* is accommodated in the second recessed portion 17*b*. Moreover, the clearance which is formed when the second protruding portion 18*b* is accommodated in the second recessed portion 17*b* is narrower than the clearance which is formed when the third protruding portion 18*c* is accommodated in the third recessed portion 17*c*.

Alternatively, the width of the groove of the first recessed portion 17*a*, the width of the groove of the second recessed portion 17*b*, and the width of the groove of the third recessed portion 17*c* may be different from each other, and the thickness of the first protruding portion 18*a*, the thickness of the second protruding portion 18*b*, and the thickness of the third protruding portion 18*c* may be different from each other. Each of the width of the recessed portion 17 and the thickness of the protruding portion 18 may be configured to be anyone as long as the clearance which is formed when the first protruding portion 18*a* is accommodated in the first recessed portion 17*a* is narrower than the clearance which is formed when the second protruding portion 18*b* is accommodated in the second recessed portion 17*b*, and the clearance which is formed when the second protruding portion 18*b* is accommodated in the second recessed portion 17*b* is narrower than the clearance which is formed when the third protruding portion 18*c* is accommodated in the third recessed portion 17*c*.

Similarly to the cryocooler 1 according to the first embodiment, the clearance which is formed when the recessed portion 17 receives the protruding portion 18 functions as a heat exchanger. Accordingly, compared to a case where the recessed portion 17 and the protruding portion 18 are not formed, since the clearance functions as a heat exchanger, the heat exchange area between the working gas and the cooling stage 5 increases, and heat exchange efficiency increases. In addition, the operation in which the protruding portion 18 is inserted into the recessed portion 17 is repeated according to the reciprocation of the displacer 2. As a result, turbulence is generated in the working gas in the expansion space 3. Accordingly, it is possible to further increase the heat exchange efficiency between the working gas and the cooling stage 5.

Much more working gas exists in the outer side of the expansion space 3 than in the inner side thereof. In the cryocooler 1 according to the second embodiment, in the outer side of the expansion space 3 in which much more working gas exists, the clearance which is formed when the recessed portion 17 receives the protruding portion 18 decreases.

In general, efficiency of heat exchange increase as the clearance decreases. Accordingly, in the cryocooler 1 according to the second embodiment, since the heat exchange efficiency increases on the outer side of the expansion space 3 in which much more working gas exists, it is possible to the overall heat exchange efficiency of the cryocooler 1.

As described above, according to the cryocooler 1 according to the second embodiment, it is possible to increase the heat exchange area between the working gas and the cooling stage 5 when the working gas expanded in the expansion space 3 is recovered to the internal space of the displacer 2. In addition, it is possible to generate turbulence in the working gas when the protruding portion 18 is accommodated in the recessed portion 17. Accordingly, it is possible to improve the heat exchange efficiency between the working gas and the cooling stage 5, and it is possible to improve refrigerating performance of the cryocooler 1.

Third Embodiment

As described above, in a fin type heat exchanger in which the protruding portion 18 and the recessed portion 17 of the first and second embodiments are combined, preferably, a narrow clearance between the protruding portion 18 and the recessed portion 17 is formed to improve heat exchange efficiency. The improvement of the heat exchange efficiency contributes to the improvement of refrigerating capacity of the cryocooler 1. However, a clearance which is too narrow increases a resistance force with respect to the movement of the displacer 2 due to viscosity of the working gas which flows through the clearance. In addition, if the flow resistance of the working gas is excessive, the amount of the working gas supplied to the expansion space 3 may be insufficient. Accordingly, the clearance which is too narrow may decrease the refrigerating capacity of the cryocooler 1.

Considering the above-described tradeoff relationship, compared to the cryocoolers 1 according to the first and second embodiments, in a cryocooler 1 according to the third embodiment, the width of the fin base portion of the heat exchanger provided in the cooling stage 5 is narrower. That is, the width of the fin base portion is smaller than the width of the fin tip portion. In this way, the fin type heat exchanger of the cryocooler 1 according to the third embodiment has the clearance which is partially enlarged. Since the flow resistance of the working gas is correlated with the width of the clearance, the enlarged clearance can decrease the flow resistance. Similarly to the cryocoolers 1 according to the first and second embodiments, the tip portion of the heat exchanger fin forms a narrow clearance. Accordingly, it is possible to obtain advantages such as improvement of heat exchange efficiency.

Accordingly, in the third embodiment, at least one annular protruding portion 18 of the plurality of annular protruding portions 18 includes an annular tip portion and an annular thin portion which connects the annular tip portion to the bottom surface of the expansion space 3. A narrow clearance is formed between the annular tip portion and the annular recessed portion 17 which receives the annular protruding portion 18. A wide clearance is formed to be continuous to the narrow clearance between the annular thin portion and the annular recessed portion 17 which receives the annular protruding portion 18.

The cryocooler 1 according to the third embodiment will be described with reference to FIG. 5. Hereinafter, descriptions overlapping those of the cryocooler 1 according to the first embodiment and/or the second embodiment are appropriately omitted or simplified.

Figure 5:
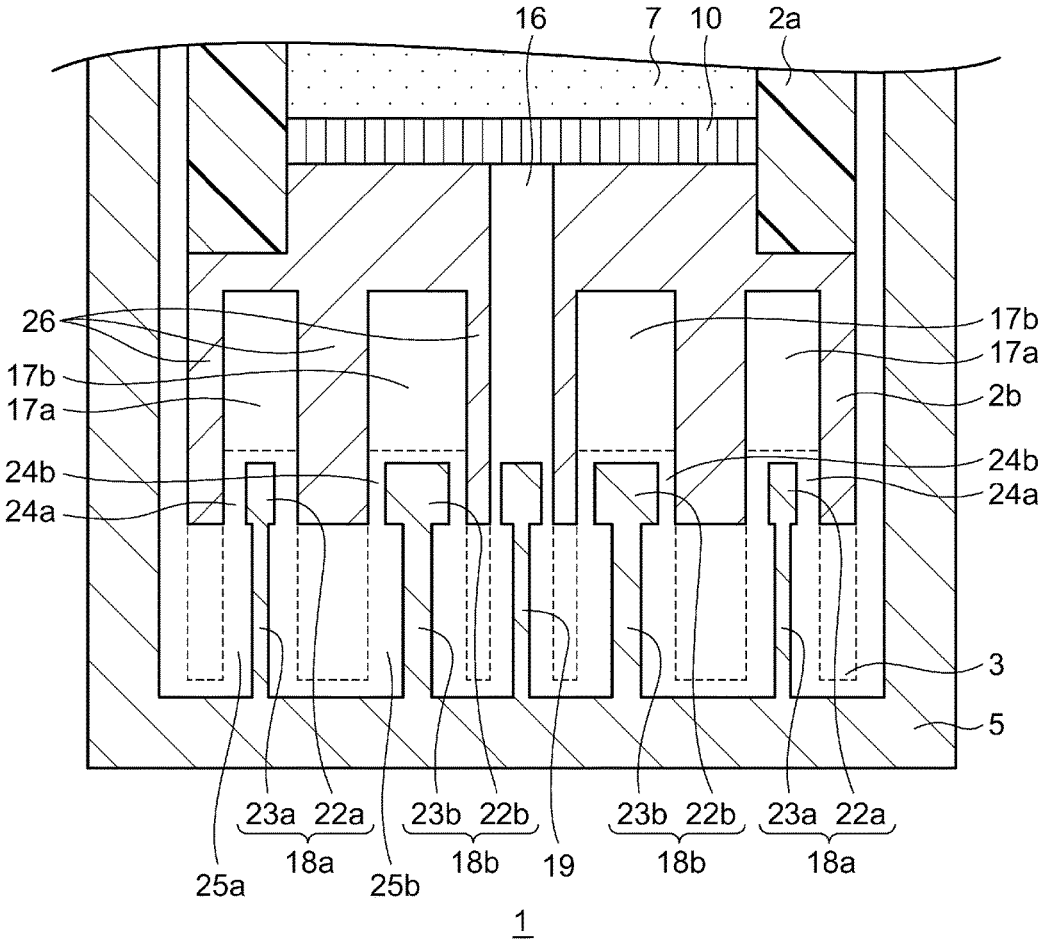
FIG. 5 is a view schematically showing a low-temperature portion of a cryocooler according to a third embodiment of the present invention.

FIG. 5 is a view schematically showing a low-temperature portion of the cryocooler 1 according to a third embodiment of the present invention. The cryocooler 1 shown in FIG. 5 includes a combination between a heat exchanger fin (that is, protruding portion 18) having a partially thin width in the axial direction and a vertical blowing type working gas blow-off port similar to the first embodiment. FIG. 5 shows an aspect in which the displacer is positioned at the top dead center. In addition, for understanding, in FIG. 5, the aspect in which the displacer is positioned at the bottom dead center is shown by broken lines.

As shown in FIG. 5, the plurality of annular protruding portions 18 include the first annular protruding portion 18*a* and the second annular protruding portion 18*b* which is surrounded by the first annular protruding portion 18*a*. The second protruding portion 18*b* surrounds the center axis of the cylinder. In addition, the plurality of annular recessed portions 17 include the first annular recessed portion 17*a* which receives the first protruding portion 18*a*, and the second annular recessed portion 17*b* which receives the second protruding portion 18*b*. The bottom portion 2*b* of the displacer includes a displacer protruding portion 26 which divides the recessed portion 17 into recessed portions 17 adjacent to each other, or into the flow channel 16 and the recessed portion 17 adjacent to the flow channel 16.

The first protruding portion 18*a* includes a first annular tip portion 22*a* and a first annular thin portion 23*a*. The first thin portion 23*a* connects the first tip portion 22*a* to the bottom surface of the expansion space 3, that is, to the internal bottom surface of the cooling stage 5. The first annular tip portion 22*a* forms a first narrow clearance 24*a* in the first annular recessed portion 17*a*. The first annular thin portion 23*a* forms a first wide clearance 25*a* in the first annular recessed portion 17*a*. The first wide clearance 25*a* is continued to the first narrow clearance 24*a* in the axial direction. The first narrow clearances 24*a* are formed on both sides in the radial direction of the first tip portion 22*a*, and the first wide clearances 25*a* are formed on both sides in the radial direction of the first thin portion 23*a*. The width of the first narrow clearance 24*a* is smaller than the width of the first wide clearance 25*a* in the radial direction. Here, the radial direction is a direction perpendicular to the axial direction and the circumferential direction of the cylinder. In general, the circumferential direction is the extension direction of the annular protruding portion 18 which extends so as to surround the axis.

Similarly, the second protruding portion 18*b* includes a second annular tip portion 22*b* and a second annular thin portion 23*b*. The second thin portion 23*b* connects the second tip portion 22*b* to the bottom surface of the expansion space 3. The second annular tip portion 22*b* forms a second narrow clearance 24*b* in the second annular recessed portion 17*b*, and the second annular thin portion 23*b* forms a second wide clearance 25*b* in the second annular recessed portion 17*b*. The second wide clearance 25*b* is continued to the second narrow clearance 24*b* in the axial direction. The second narrow clearance 24*b* and the second wide clearance 25*b* are formed on both sides in the radial direction of the second protruding portion 18*b*. The width of the second narrow clearance 24*b* in the radial direction is smaller than the width of the second wide clearance 25*b* in the radial direction.

In the third embodiment, the relationship between the distance from the center axis and the width of the clearance is similar to that of the first embodiment. In the clearances which are formed when the recessed portion 17 accommodates the protruding portion 18, the clearance which is formed to be far from the center axis of the displacer is formed to be wider than the clearance which is formed to be close to the center axis thereof. Accordingly, the radial width of the first narrow clearance 24*a* is wider than the radial width of the second narrow clearance 24*b*, and the radial width of the first wide clearance 25*a* is wider than the radial width of the second wide clearance 25*b*.

In addition, the width of the clearance formed in the recessed portion 17 corresponding to a protruding portion 18 may be the same as the width of the clearance which is formed in another recessed portion 17 corresponding to another protruding portion 18. Accordingly, the radial width of the first narrow clearance 24*a* may be the same as the radial width of the second narrow clearance 24*b*. The radial width of the first wide clearance 25*a* is the same as the radial width of the second wide clearance 25*b*.

In the following specification, in a case where the first tip portion 22*a* and the second tip portion 22*b* are not particularly classified, the first tip portion 22*a* and the second tip portion 22*b* are collectively referred to as a "tip portion 22." In addition, in a case where the first thin portion 23*a* and the second thin portion 23*b* are not particularly classified, the first thin portion 23*a* and the second thin portion 23*b* are collectively referred to as a "thin portion 23." Similarly, the narrow clearances and the wide clearances are collectively referred to as a "narrow clearance 24" and a "wide clearance 25", respectively.

The narrow clearance 24 is formed between the tip portion 22 and the displacer protruding portion 26 in the radial direction. The wide clearance 25 is formed between the thin portion 23 and the displacer protruding portion 26 in the radial direction.

Similarly to the recessed portion 17, the bar-shaped member 19 also includes a thin base portion. That is, the bar-shaped member 19 includes a tip portion and a small-diameter portion which connects the tip portion to the bottom surface of the expansion space 3. The tip portion of the bar-shaped member 19 forms a narrow clearance in the flow channel 16. The small-diameter portion of the bar-shaped member 19 forms a wide clearance in the flow channel 16. The bar-shaped member 19 has an axial height which is the same as that of the protruding portion 18.

As shown in the drawings, the thin portion 23 forms the wide clearance 25 in the recessed portion 17 when the displacer is positioned at the bottom dead center. The wide clearance 25 is open when the displacer is positioned at the top dead center. Accordingly, preferably, the axial height of the thin portion 23 or the small-diameter portion is larger than ⅓ of the axial entire height of the protruding portion 18 and smaller than ⅔ thereof. The axial height is a length which is measured in the axial direction from the bottom surface of the expansion space 3.

The cryocooler 1 is configured such that axial overlapping between the protruding portion 18 and the bottom portion 2*b* of the displacer is maintained always. Accordingly, at least the upper portion of the protruding portion 18 is received in the recessed portion 17 during one period of the reciprocation of the displacer. In the third embodiment, the tip portion 22 is always accommodated in the recessed portion 17. As shown in the drawings, when the displacer is positioned at the top dead center, the tip portion 22 is positioned inside the recessed portion 17, and the thin portion 23 is positioned outside the recessed portion 17. For example, the axial length of the overlapping portion between the protruding portion 18 and the bottom portion 2*b* of the displacer when the displacer is positioned at the top dead center may be less than ⅓, ⅕, or 1/10 of the axial entire height of the protruding portion 18.

Accordingly, when the displacer moves upward from the bottom dead center or the vicinity thereof, that is, when the working gas is supplied from the displacer to the expansion space 3, the wide clearance 25 is formed between the bottom portion 2*b* of the displacer and the protruding portion 18. Since the width is wide, the working gas easily flows, and the resistance with respect to the movement of the displacer decreases. Meanwhile, when the displacer moves downward from the top dead center or the vicinity thereof, that is, when the expanded and cooled working gas is recovered from the expansion space 3 to the displacer, the working gas passes through the narrow clearance 24. Sufficient heat exchange is performed in the narrow clearance 24. In this way, as described above, it is possible to improve the refrigerating capacity and heat exchange efficiency by decreasing a side effect generated due to the clearance which is too narrow.

In addition, the protruding portion 18 has one step portion between the tip portion 22 and the thin portion 23. However, the present invention is not limited to this. The protruding portion 18 may have two or more step portions. For example, in a case where the protruding portion 18 has two or more steps, the protruding portion 18 may have a tip portion, an intermediate portion which is thinner than the tip portion, and a base portion which is thinner than the intermediate portion. Alternatively, the protruding portion 18 may have a smooth surface instead of stepped surfaces from the tip portion 22 to the thin portion 23. For example, the protruding portion 18 may have a smooth surface which is formed so as to be gradually widened from the narrow clearance 24 to the wide clearance 25.

Figure 6:
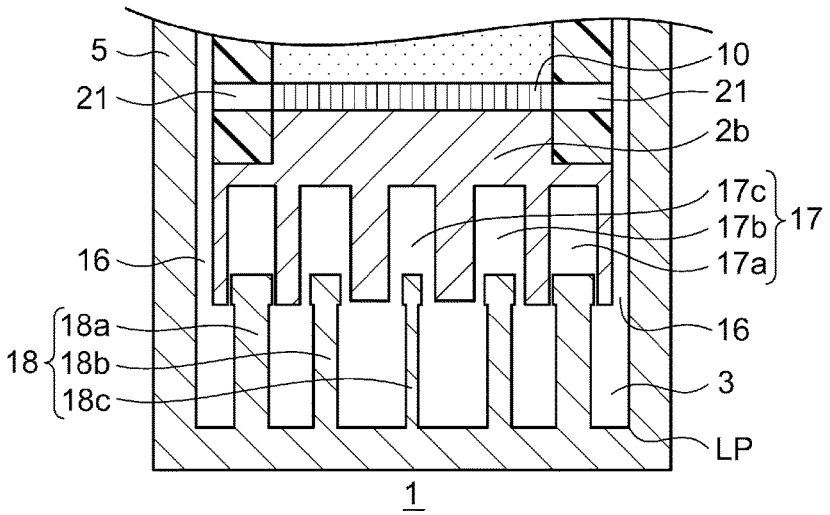
FIG. 6 is a view schematically showing the low-temperature portion of the cryocooler according to the third embodiment of the present invention.

The cryocooler 1 may have a combination between the heat exchanger fin which is a partially thin in the axial direction and a lateral blowing type blow-off port 21. In this case, as shown in FIG. 6, the relationship between the distance from the center axis and the width of the clearance is similar to that of the second embodiment. Accordingly, the first narrow clearance may be narrower than the second narrow clearance. The first wide clearance may be narrower than the second wide clearance.

Fourth Embodiment

Figure 7:
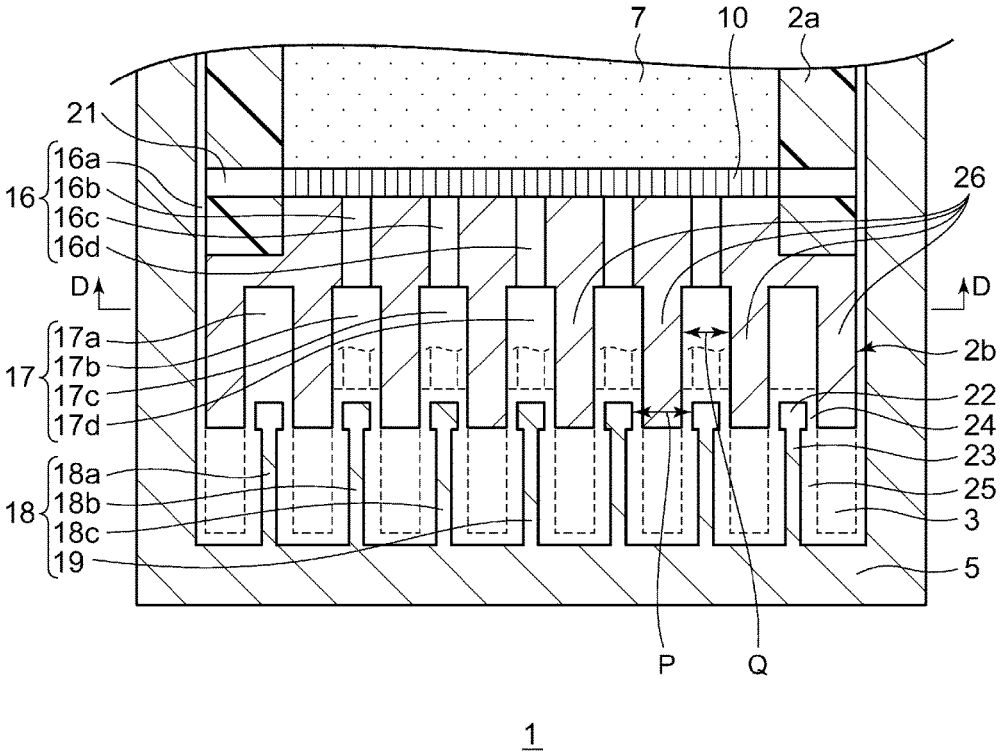
FIG. 7 is a view schematically showing a low-temperature portion of a cryocooler according to a fourth embodiment of the present invention.
Figure 8:
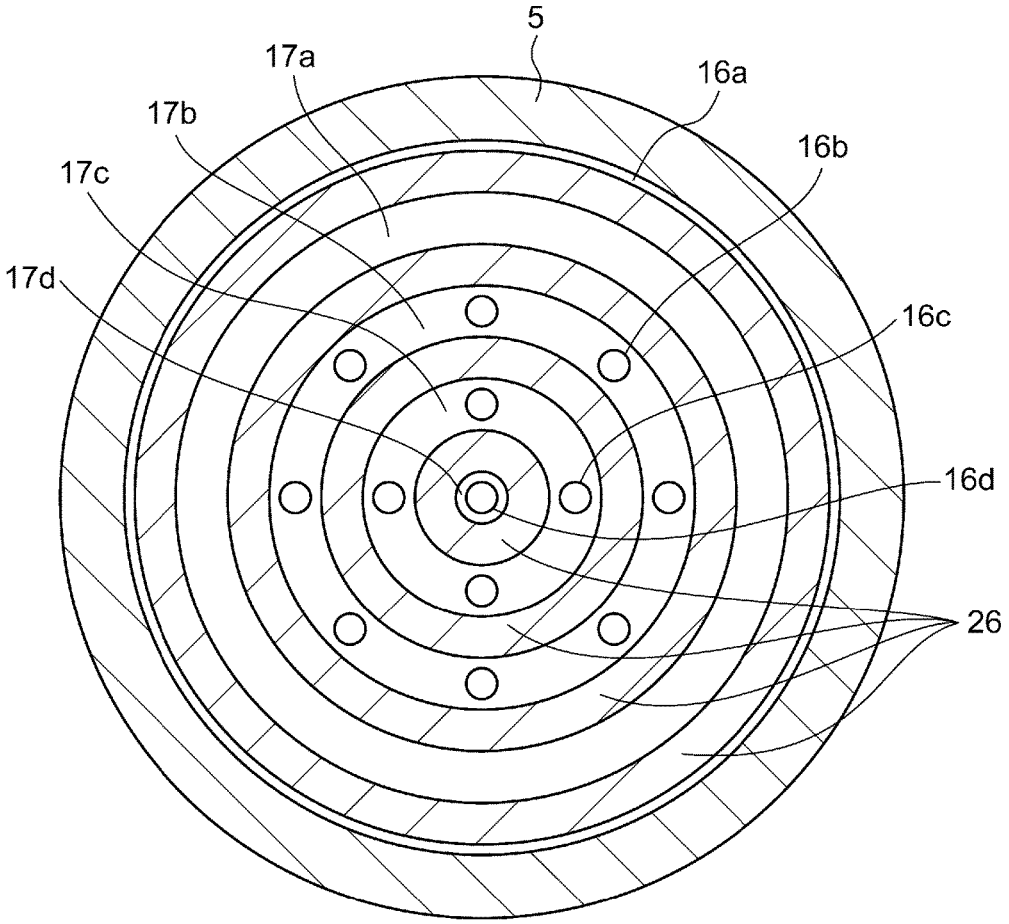
FIG. 8 is a view schematically showing a cross section when the cryocooler according to the fourth embodiment is taken along a plan perpendicular to an axial direction of a cylinder.

FIG. 7 is a view schematically showing a low-temperature portion of a cryocooler 1 according to a fourth embodiment of the present invention. FIG. 7 shows an aspect in which the displacer is positioned at the top dead center. In addition, for understanding, in FIG. 7, the aspect in which the displacer is positioned at the bottom dead center is shown by broken lines. In addition, FIG. 8 is a view schematically showing a cross section when the cryocooler 1 according to the fourth embodiment is taken along a plan perpendicular to the axial direction of the cylinder. More specifically, FIG. 8 is a view showing a cross section taken along line D-D in FIG. 7. Hereinafter, descriptions overlapping those of the cryocoolers 1 according to the above-described embodiments are appropriately omitted or simplified.

Similarly to the cryocooler 1 according to the third embodiment, the cryocooler 1 shown in FIGS. 7 and 8 includes the heat exchanger fin (that is, protruding portion 18) having a partially thin width in the axial direction. However, the flow channel configuration of the working gas is different from that of the third embodiment. The cryocooler 1 shown in FIGS. 7 and 8 includes a plurality of vertical blowing type working gas blow-off ports, and the lateral blowing type blow-off port 21 similar to that of each of the cryocoolers 1 shown in FIGS. 4 and 6.

Although it is described in detail below, the cryocooler 1 includes at least one working gas flow channel which penetrates the bottom portion 2*b* of the displacer and connects the internal space of the displacer and an annular recessed portion of the plurality of annular recessed portions 17. In addition, a gap between an annular protruding portion among the plurality of annular protruding portions 18 and another annular protruding portion adjacent to the annular protruding portion is wider than a width of an annular recessed portion, which receives the annular protruding portion, among the plurality of annular recessed portions 17.

As shown in FIG. 7, the plurality of annular protruding portions 18 includes the first annular protruding portion 18*a*, the second annular protruding portion 18*b* which is surrounded by the first annular protruding portion 18*a*, and the third annular protruding portion 18*c* which is surrounded by the second annular protruding portion 18*b*. The third protruding portion 18*c* surrounds the bar-shaped member 19 which is disposed on the center axis of the cylinder. The bar-shaped member 19 may be one of the protruding portions 18. In addition, the plurality of annular recessed portions 17 include the first annular recessed portion 17*a* which receives the first protruding portion 18*a*, the second annular recessed portion 17*b* which receives the second protruding portion 18*b*, and the third annular recessed portion 17*c* which receives the third protruding portion 18*c*. In addition, a fourth recessed portion 17*d* which receives the bar-shaped member 19 is provided on the bottom portion 2*b* of the displacer. The fourth recessed portion 17*d* may be one of the recessed portions 17. The bottom portion 2*b* of the displacer includes the displacer protruding portion 26 which divides the recessed portion 17 into recessed portions 17 adjacent to each other.

The cryocooler 1 includes the plurality of working gas flow channels 16 which connect the internal space (that is, regenerator 7) of the displacer and the expansion space 3. The flow channel 16 includes a first flow channel 16*a*, a second flow channel 16*b*, a third flow channel 16*c*, and a fourth flow channel 16*d*. The first flow channel 16*a* is a clearance between the side wall of the displacer and the inner wall of the cylinder, and connects the blow-off port 21 to the expansion space 3.

The second flow channel 16*b* penetrates the bottom portion 2*b* of the displacer 2 and causes the internal space of the displacer to communicate with the second recessed portion 17*b*. Similarly, each of the third flow channel 16*c* and the fourth flow channel 16*d* penetrates the bottom portion 2*b* of the displacer and causes the internal space of the displacer to communicate with each of the third recessed portion 17*c* and the fourth recessed portion 17*d*. As shown in FIG. 8, the second flow channel 16*b* is configured of a plurality of (eight in the drawing) through holes. The third flow channel 16*c* is configured of a plurality of (four in the drawing) through holes. The through holes are formed on the bottom portion 2*b* of the displacer at equal intervals in the circumferential direction. The fourth flow channel 16*d* is a single hole which penetrates the center portion of the bottom portion 2*b* of the displacer.

In this way, the cryocooler 1 includes the plurality of vertical blowing type working gas blow-off ports, specifically, the second flow channel 16*b*, the third flow channel 16*c*, and the fourth flow channel 16*d*. In addition to the fourth flow channel 16*d* positioned at the center, the second flow channel 16*b* and the third flow channel 16*c* are provided around the fourth flow channel 16*d*. Since the blow-off flow channel of the working gas is widened, the heat exchange area increases, and the heat exchange between the working gas and the heat exchange fin (that is, the protruding portion 18) is promoted. Accordingly, it is possible to improve refrigerating performance of the cryocooler 1. In addition, since the blow-off flow channel of the working gas is widened, the flow resistance of the working gas is decreased, and a load of a driving motor of the cryocooler 1 is also decreased.

Each protruding portion 18 includes the tip portion 22 and the thin portion 23. The narrow clearance 24 is formed in the recessed portion 17 corresponding to the tip portion 22, and the wide clearance 25 is formed in the recessed portion 17 corresponding to the thin portion 23. In the fourth embodiment, the relationship between the distance from the center axis and the width of the clearance is different from that of each of the first to third embodiments. In the fourth embodiment, the width of the clearance is constant regardless of the distance from the center axis. Accordingly, the radial widths of the plurality of protruding portions 18 are the same as each other. In addition, the radial widths of the plurality of recessed portions 17 are the same as each other. However, similarly to other embodiments, in the fourth embodiment, the distance from the center axis and the width of the clearance may be correlated with each other.

A gap P between an annular protruding portion 18 among the plurality of annular protruding portions 18 and another annular protruding portion 18 adjacent to the annular protruding portion is wider than a width Q of an annular recessed portion 17 which receives the annular protruding portion 18 (or adjacent another protruding portion 18). In other words, the total width P of the displacer protruding portion 26 and clearances positioned on both sides of the displacer protruding portion 26 is wider than the gap P between the displacer protruding portion 26 and the adjacent displacer protruding portion 26.

In an exhaust step of the cryocooler 1 (that is, when the displacer moves to the bottom dead center), since the working gas existing the recessed portion 17 is immediately returned from the flow channel 16 to the regenerator 7, the contribution of the working gas with respect to cooling is small. Meanwhile, the working gas existing between two protruding portions 18 adjacent to each other is returned to the regenerator 7 through the clearance between the protruding portion 18 and the displacer protruding portion 26. In this case, since heat exchange is performed between the working gas and the protruding portion 18, the contribution of the working gas existing between the protruding portions 18 with respect to cooling is large. As described above, since the gap P between the protruding portions 18 is wider than the width Q of the recessed portion 17, it is possible to increase the volume of the working gas existing between the protruding portions 18. Accordingly, heat exchange between the working gas and the heat exchange fin is promoted, and the refrigerating performance of the cryocooler 1 is improved.

Fifth Embodiment

Figure 9:
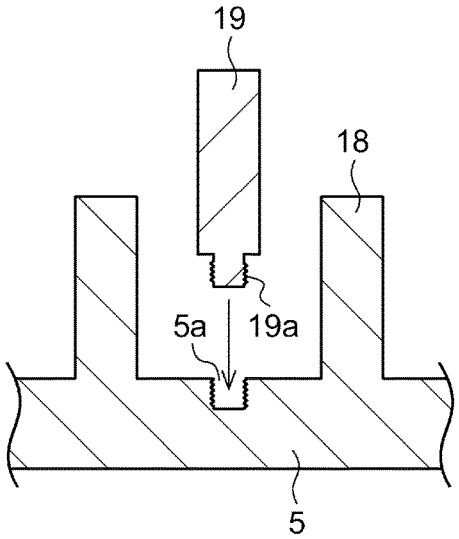
FIG. 9 is a view schematically showing a portion of a low-temperature portion of a cryocooler according to a fifth embodiment of the present invention.

FIG. 9 is a view schematically showing a portion of a low-temperature portion of a cryocooler 1 according to a fifth embodiment of the present invention. The bar-shaped member 19 is manufactured as a member separated from the cooling stage 5, and is attached to the cooling stage 5. Accordingly, the bar-shaped member 19 has a screw portion 19*a* on the lower end. The cooling stage 5 has a screw hole 5*a* corresponding to the screw portion 19*a*. The bar-shaped member 19 is fixed to the cooling stage 5 by screwing the screw portion 19*a* of the bar-shaped member 19 to the screw hole 5*a* of the cooling stage 5. The bar-shaped member 19 is reliably fixed to the cooling stage 5 by brazing.

When the bar-shaped member 19 is removed, the space inside the third protruding portion 18*c* is wider than the space when the bar-shaped member 19 is attached to the cooling stage 5. Accordingly, it is possible to easily process the third protruding portion 18*c*. In this way, since the bar-shaped member 19 is configured of a separate member, it is possible to easily manufacture the protruding portion 18 of the cooling stage 5. Particularly, this is effective to a case where the protruding portion 18 is formed of a relatively soft metal such as copper.

Alternatively, the bar-shaped member 19 may be fixed to the cooling stage 5 by press fitting or other fixing means instead of the screw engagement.

Similarly, at least one among the displacer protruding portions 26 is manufactured as a member separated from the displacer, and may be attached to the displacer by screw fitting, press fitting, or other fixing means. At least one among the protruding portions 18 is manufactured as a member separated from the cooling stage 5, and may be attached to the cooling stage 5 by screw fitting, press fitting, or other fixing means.

Figure 10:
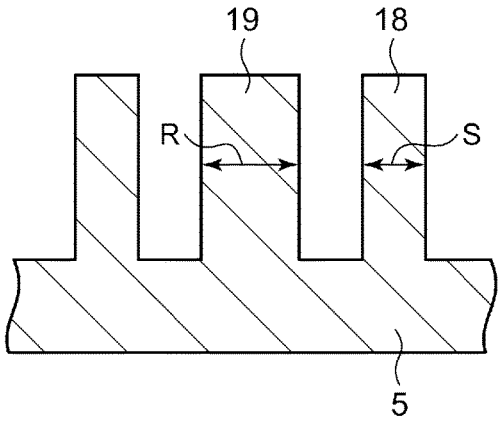
FIG. 10 is a view schematically showing a portion of the low-temperature portion of the cryocooler according to the fifth embodiment of the present invention.

Alternatively, as shown in FIG. 10, a diameter R of the bar-shaped member 19 may be larger than a radial width S of another protruding portion 18 (for example, adjacent protruding portion). Accordingly, rigidity of the bar-shaped member 19 increases and it is possible to prevent the bar-shaped member 19 from being deformed by interference with a tool during processing of the third protruding portion 18*c*. Therefore, it is possible to easily manufacture the cooling stage 5.

The cooling stage 5 shown in FIG. 9 may be applied to any one of the first to fourth embodiments. Similarly, the cooling stage 5 shown in FIG. 10 may be applied to any one of the first to fourth embodiments.

It should be understood that the invention is not limited to the above-described embodiments, but may be modified into various forms on the basis of the spirit of the invention. Additionally, the modifications are included in the scope of the invention.

For example, in the above-described cryocooler, the case where the number of steps is one is described. However, the number of steps may be 2 or more, and may be appropriately selected. In addition, in each embodiment, the case where the cryocooler is a GM cryocooler is described. However, the present invention is not limited to this. For example, the present invention maybe also applied to a cryocooler in which the displacer is not provided such as a Stirling cryocooler or a Solvay cryocooler.

In the cryocooler 1 according to each embodiment, the case where the cryocooler 1 includes the annular protruding portion 18 and the annular recessed portion 17 which is formed so as to receive the protruding portion 18 is described. However, the shape of each of the recessed portion 17 and the protruding portion 18 is not limited to the annular shape. For example, the shape of each of the recessed portion 17 and the protruding portion 18 may be a polygonal shape or a star shape as long as it is a closed graphic. Meanwhile, even when the relative position between the displacer 2 and the cylinder 4 rotates about the axis of the cylinder 4, since the recessed portion 17 can receive the protruding portion 18 without any trouble, the case where each of the recessed portion 17 and the protruding portion 18 is formed in an annular shape is advantageous.

In the cryocooler 1 according to the first embodiment, the case where two recessed portions 17 and two protruding portions 18 are provided is described. However, the number of each of the recessed portions 17 and the protruding portions 18 is not limited to two, and may exceed two. In addition, in the cryocooler 1 according to the second embodiment, the case where the number of each of the recessed portions 17 and the protruding portions 18 is three is described. However, the number of each of the recessed portions 17 and the protruding portions 18 is not limited to three. For example, the number of each of the recessed portions 17 and the protruding portions 18 may be two or four or more.

What is claimed is:

1. A cryocooler comprising:

a displacer having an internal space, for a working gas to flow through the internal space;

a cylinder, reciprocally accommodating the displacer, between a bottom portion of the displacer and which an expansion space for the working gas is formed;

a plurality of annular protruding portions provided on a bottom surface of the expansion space such as to form a multiplex structure;

a plurality of annular recessed portions provided on the bottom portion of the displacer such as to receive the plurality of annular protruding portions; and a first working gas flow channel centrally penetrating the bottom portion of the displacer and joining the internal space in the displacer with the expansion space, and, radially outward of the first working gas flow channel, a second working gas flow channel penetrating the bottom portion of the displacer, and through which the internal space in the displacer is joined with a given annular recessed portion among the plurality of annular recessed portions.

2. A cryocooler comprising:

a displacer having an internal space, for a working gas to flow through the internal space;

a cylinder, reciprocally accommodating the displacer, between a bottom portion of the displacer and which an expansion space for the working gas is formed;

a plurality of annular protruding portions provided on a bottom surface of the expansion space such as to form a multiplex structure;

a plurality of annular recessed portions provided on the bottom portion of the displacer such as to receive the plurality of annular protruding portions; and a bar-shaped member provided in a region in the expansion space opposing the flow channel, and being inserted into the flow channel at least when the displacer is positioned at bottom dead center.

3. A cryocooler comprising:

a displacer having an internal space, for a working gas to flow through the internal space;

a cylinder, reciprocally accommodating the displacer, between a bottom portion of the displacer and which an expansion space for the working gas is formed;

a plurality of annular protruding portions provided on a bottom surface of the expansion space such as to form a multiplex structure; and a plurality of annular recessed portions provided on the bottom portion of the displacer such as to receive the plurality of annular protruding portions; wherein a plurality of clearances are formed between the plurality of annular protruding portions being received in the plurality of annular recessed portions, and the plurality of annular recessed portions; and the plurality of clearances include a farther radial clearance and a nearer radial clearance, the farther radial clearance being farther from the displacer's center axis than the nearer radial clearance, and the farther radial clearance being radially wider than the nearer radial clearance.

4. A cryocooler comprising:

a displacer having an internal space, for a working gas to flow through the internal space;

a cylinder, reciprocally accommodating the displacer, between a bottom portion of the displacer and which an expansion space for the working gas is formed;

a plurality of annular protruding portions provided on a bottom surface of the expansion space such as to form a multiplex structure; and a plurality of annular recessed portions provided on the bottom portion of the displacer such as to receive the plurality of annular protruding portions; wherein a clearance between a sidewall of the displacer and an inner wall of the cylinder is a working gas flow channel joining the internal space in the displacer with the expansion space;

the displacer includes a blowoff port for introducing the working gas into the clearance; and a plurality of clearances are formed between the plurality of annular protruding portions being accommodated in the plurality of annular recessed portions, and the plurality of annular recessed portions, the plurality of clearances including a nearer radial clearance and a farther radial clearance, the nearer radial clearance being nearer to the displacer's center axis than the farther radial clearance, and the nearer radial clearance being radially wider than the farther radial clearance.

5. The cryocooler the plurality of annular recessed portions are formed to accommodate the plurality of annular protruding portions when the displacer is positioned at top dead center.

6. A cryocooler comprising:

a displacer having an internal space, for a working gas to flow through the internal space;

a cylinder, reciprocally accommodating the displacer, between a bottom portion of the displacer and which an expansion space for the working gas is formed;

a plurality of annular protruding portions provided on a bottom surface of the expansion space such as to form a multiplex structure; and a plurality of annular recessed portions provided on the bottom portion of the displacer such as to receive the plurality of annular protruding portions; wherein at least one annular protruding portion among the plurality of annular protruding portions is provided with an annular tip portion and an annular trimmed portion connecting the annular tip portion to the bottom surface of the expansion space; and in the annular recessed portion receiving the annular protruding portion, the annular tip portion forms a narrower radial clearance, and the annular trimmed portion forms a wider radial clearance continuous with the narrower radial clearance and radially wider than the narrower radial clearance.

7. The cryocooler according to claim 6, wherein with the at least one annular protruding portion having an axial total height directed along the cylinder's center axis, the trimmed portion has an axial height that is ⅓ to ⅔ of the axial total height.

8. A cryocooler comprising:

a displacer having an internal space, for a working gas to flow through the internal space;

a cylinder, reciprocally accommodating the displacer, between a bottom portion of the displacer and which an expansion space for the working gas is formed;

a plurality of annular protruding portions provided on a bottom surface of the expansion space such as to form a multiplex structure; and a plurality of annular recessed portions provided on the bottom portion of the displacer such as to receive the plurality of annular protruding portions; wherein the plurality of annular protruding portions includes a first annular protruding portion, and a second annular protruding portion surrounded by the first annular protruding portion;

the plurality of annular recessed portions includes a first annular recessed portion and a second annular recessed portion respectively receiving the first annular protruding portion and the second annular protruding portion;

the first annular protruding portion includes a first annular tip portion and a first annular trimmed portion connecting the first annular tip portion to the bottom surface of the expansion space, the first annular tip portion forming a first narrower radial clearance in the first annular recessed portion, and the first annular trimmed portion forming a first wider radial clearance continuous with the first narrower radial clearance in the first annular recessed portion and radially wider than the first narrower radial clearance;

the second annular protruding portion includes a second annular tip portion and a second annular trimmed portion connecting the second annular tip portion to the bottom surface of the expansion space, the second annular tip portion forming a second narrower radial clearance in the second annular recessed portion, and the second annular trimmed portion forming a second wider radial clearance continuous with the second narrower radial clearance in the second annular recessed portion and radially wider than the second narrower radial clearance; and either the first narrower radial clearance is wider than the second narrower radial clearance, and the first wider radial clearance is wider than the second wider radial clearance, or the first narrower radial clearance is narrower than the second narrower radial clearance, and the first wider radial clearance is narrower than the second wider radial clearance.

9. The cryocooler:

a clearance between a sidewall of the displacer and an inner wall of the cylinder is a working gas flow channel joining the internal space in the displacer with the expansion space; and the displacer includes a blowoff port for introducing the working gas into the clearance.

10. The cryocooler a gap between a given annular protruding portion among the plurality of annular protruding portions and an annular protruding portion adjacent to the given annular protruding portion is of greater widthwise dimension than that of the annular recessed portion receiving the given annular protruding portion among the plurality of annular recessed portions.

11. The cryocooler the bottom portion of the displacer is made of copper or aluminum.

* * * * *